United States Patent [19]

Pere

[11] 4,323,443

[45] Apr. 6, 1982

[54] ELECTROLYZER HAVING A HORIZONTAL TUBULAR ENCLOSURE

[75] Inventor: Gérard Pere, Le Breuil, France

[73] Assignee: Creusot-Loire, Paris, France

[21] Appl. No.: 117,653

[22] Filed: Feb. 1, 1980

[30] Foreign Application Priority Data

Jul. 2, 1979 [FR] France ..... 79 03797

[51] Int. Cl.[3] ..... C25B 9/00

[52] U.S. Cl. ..... 204/253; 204/267; 204/279; 204/286

[58] Field of Search ..... 204/253-258, 204/263-266, 267-270, 279, 129, 286

[56] References Cited

U.S. PATENT DOCUMENTS 1,660,147 2/1928 Allan ..... 204/256 X
3,682,799 8/1972 Jumer ..... 204/286 X

FOREIGN PATENT DOCUMENTS 2394620 2/1979 France ..... 204/258
1145751 3/1969 United Kingdom ..... 204/266

*Primary Examiner*—Donald R. Valentine
*Attorney, Agent, or Firm*—Haseltine and Lake

[57] ABSTRACT

An electrolyser consisting of a stack of elemental cells, the said stack being located in a horizontal tubular enclosure.

The enclosure consists of a fixed vertical baseplate (2) and of a tubular envelope (1) mounted upon the horizontal bed (8) of the apparatus by way of supporting rollers (7). The body of the stack (4) is supported during the opening operation by chocks (12) and by supporting rollers.

The invention is made use of for the production of hydrogen and oxygen by means of industrial electrolyzers.

2 Claims, 3 Drawing Figures

ELECTROLYZER HAVING A HORIZONTAL TUBULAR ENCLOSURE

FIELD OF THE INVENTION

The present invention refers to an electrolyzer consisting of a stack of cells surrounded by a horizontal tubular enclosure.

BACKGROUND

Electrolyzers such as those intended for the industrial production of hydrogen and oxygen by the electrolysis of water are formed of a stack of a very large number of elemental cells, said stack being placed in a tubular enclosure which is generally pressurized and cylindrical.

Such an enclosure must be able to be dismantled quickly and easily in order to enable maintenance of the cells with the minimum loss of time.

SUMMARY OF THE INVENTION

The present invention refers to an electrolyzer having a horizontal tubular enclosure for rapid dismantling. It is characterized in that said tubular enclosure consists of a fixed vertical base and of a horizontal tubular body which is movable longitudinally and mounted upon a device for rolling it.

The present invention likewise refers to a method of dismantling an electrolyzer of this type, characterized in that it consists in removing said tubular body by horizontal translation and as said removal proceeds, placing supporting chocks under the body of the stack of electrolytic cells left exposed by said removal.

BRIEF DESCRIPTION OF THE DRAWINGS

The invention will be better understood by means of the following description of an embodiment by reference to the attached drawings in which.

DETAILED DESCRIPTION

Figure 1:
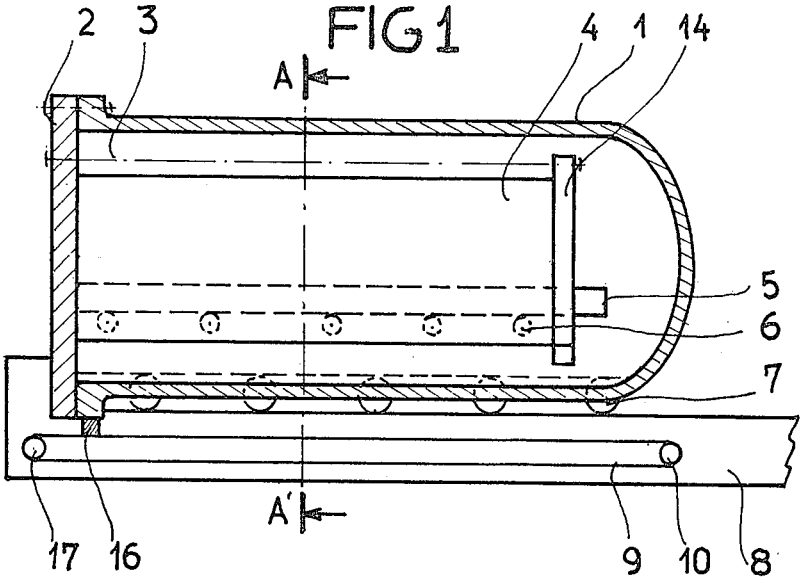
FIG. 1 represents diagrammatically an electrolyzer in accordance with the invention, its tubular enclosure being in the closed position.
Figure 3:
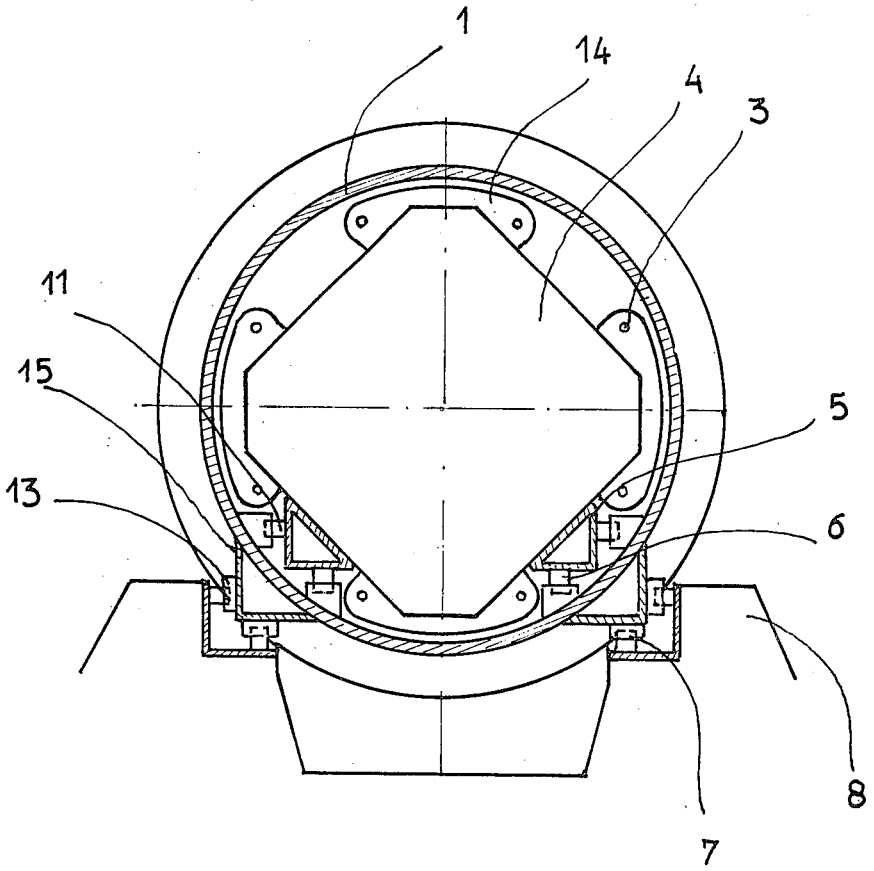
FIG. 3 is a diagrammatic axial section through the electrolyzer of the invention along the line AA' in FIG. 1.

Referring to FIGS. 1 and 3 together, the electrolyzer of the invention is formed of a horizontal stack 4 of a very large number of elemental electrolytic cells, this stack being kept in place on the baseplate 2 by means of the retainer plate 14 and eight tie rods 3.

The baseplate 2 of the electrolyzer is vertical and is permanently fixed to a horizontal bed 8 forming the frame of the apparatus. Furthermore the stack 4 is surrounded by a removable horizontal cylindrical body 1 which in the closed position as shown in FIG. 1 fits closely against the baseplate 2, the whole (1,2) forming the enclosure of the electrolyzer. The stack 4 rests upon two rollways 5 which in turn rest upon the inner portion of the envelope 1 by way of supporting rollers 6 and guide rollers 11 at the sides. Furthermore the cylindrical envelope 1 in turn rests by feet 15 upon the horizontal bed 8 by way of supporting rollers carried by the feet 15, and guide rollers 13 at the sides, likewise carried by the feet 15.

Figure 2:
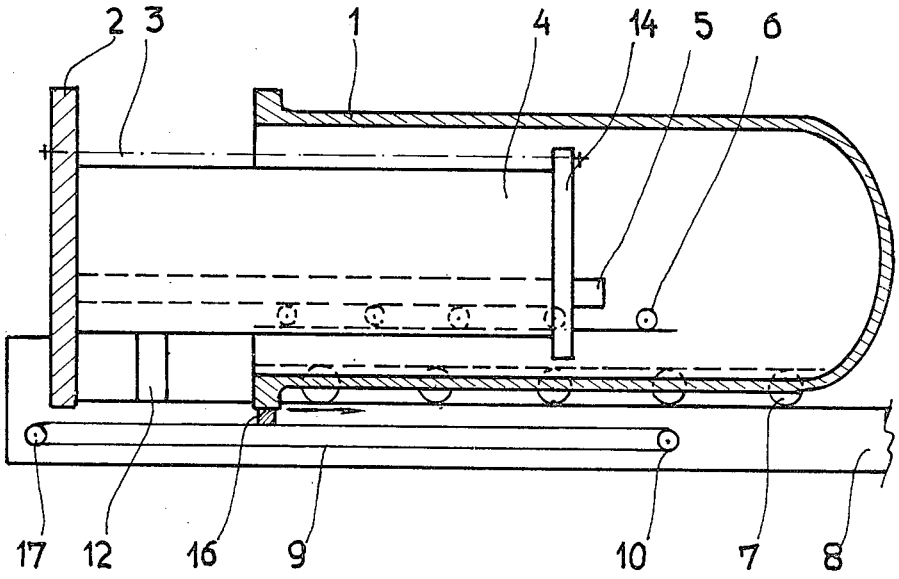
FIG. 2 represents diagrammatically an electrolyzer as FIG. 1, with its tubular enclosure in course of opening.

As may be seen from FIG. 1 the enclosure is attached by a fitting 16 to a horizontal cable located in the hollow in the bed 8 and wrapped round a driving pulley 10 and a guide pulley 17 so as to be able to exert upon the enclosure 1 a horizontal pull towards the right or towards the left, enabling opening and closing respectively of the enclosure of the electrolyzer as will be shown by reference to FIG. 2.

FIG. 2 shows the operation of opening the enclosure by lateral release of the tubular envelope 1.

For this operation the driving pulley 10 is driven clockwise, which draws the tubular portion 1 towards the right. The envelope 1 then moves by rolling by way of the rollers 7 upon the bed 8, the portion of the stack 4 which remains inside the enclosure 1 being supported by means of the rollers 6. Furthermore, in accordance with the invention, as the opening of the enclosure of the electrolyzer proceeds, supporting chocks 12 are placed under the exposed portion of the stack 4 as represented in the drawing.

The positioning of the chocks 12 as the opening of the enclosure proceeds may be either manual or automatic: for example, the chocks 12 may be parallelepipedal chocks which are laid down when the envelope 1 is lying over them above the bed 8, and raised by a conventional tripping device having a spring, when said cylindrical envelope 1 is no longer lying over them.

The invention is made use of for the production of hydrogen and oxygen by means of industrial electrolyzers.

I claim:

1. An electrolyzer comprising a stack of elemental electrolytic cells, an enclosure surrounding said stack and consisting of a vertical base attached to said stack and a movable horizontal tubular body, a horizontal base supporting said tubular body and attached to said vertical base, and a device mounted on the exterior of said tubular body so as to provide longitudinal rolling movement of said tubular body on said horizontal base.

2. The electrolyzer according to claim 1 further comprising rolling means supporting said stack and mounted on the lower interior portion of said tubular body so as to be set in rolling motion by a longitudinal movement of said tubular body.

* * * * *

UNITED STATES PATENT AND TRADEMARK OFFICE

CERTIFICATE OF CORRECTION

PATENT NO. : 4,323,443

DATED : APRIL 6, 1982

INVENTOR(S) : GERARD PERE

It is certified that error appears in the above—identified patent and that said Letters Patent is hereby corrected as shown below:

The date of the priority document should read:

February 7, 1979

Signed and Sealed this

*Twenty-ninth* Day of *June 1982*

[SEAL]

*Attest:*

GERALD J. MOSSINGHOFF

*Attesting Officer*

*Commissioner of Patents and Trademarks*